US012225934B2

(12) United States Patent
Qiu

(10) Patent No.: US 12,225,934 B2
(45) Date of Patent: Feb. 18, 2025

(54) ATOMIZER AND ELECTRONIC CIGARETTE HAVING THE SAME

(71) Applicant: JOYETECH EUROPE HOLDING GMBH, Zug (CH)

(72) Inventor: Weihua Qiu, Changzhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 1567 days.

(21) Appl. No.: 16/462,236

(22) PCT Filed: Oct. 26, 2017

(86) PCT No.: PCT/CN2017/107794

§ 371 (c)(1),
(2) Date: May 19, 2019

(87) PCT Pub. No.: WO2018/090804

PCT Pub. Date: May 24, 2018

(65) Prior Publication Data

US 2019/0328044 A1 Oct. 31, 2019

(30) Foreign Application Priority Data

Nov. 18, 2016 (CN) ..... 201611019773.X

(51) Int. Cl.
*A24F 40/42* (2020.01)
*A24F 40/10* (2020.01)
(Continued)

(52) U.S. Cl.
CPC ..... *A24F 40/40* (2020.01); *A24F 40/42* (2020.01); *A24F 40/49* (2020.01); *A24B 15/167* (2016.11); *A24F 40/10* (2020.01); *A24F 40/485* (2020.01)

(58) Field of Classification Search
CPC ..... A24F 40/42; A24F 40/485
(Continued)

(56) References Cited

U.S. PATENT DOCUMENTS

2016/0219935 A1 8/2016 Qiu

FOREIGN PATENT DOCUMENTS

CN 102241296 A 11/2011
CN 104082863 A 10/2014
(Continued)

OTHER PUBLICATIONS

Machine Translation of CN 206390297 (Year: 2017).*
Machine Translation of WO 2016/004576 (Year: 2016).*
Machine Translation of WO 2017/028167 (Year: 2017).*

*Primary Examiner* — Kelly M Gambetta
*Assistant Examiner* — Russell E Sparks
(74) *Attorney, Agent, or Firm* — Cheng-Ju Chiang

(57) ABSTRACT

An atomizer includes a liquid storage pipe having a liquid storage chamber, a connecting member, an adjusting member rotatably received in the connecting member, a pressing cover, and an air intake cover provided with a clamping claw capable of driving the adjustment member to rotate. A bottom wall of the connecting member is provided with a first liquid inlet hole communicating with the liquid storage chamber. The adjusting member is provided with a third liquid inlet hole corresponding to the first liquid inlet hole. The pressing cover is provided with at least one clamping groove. When the air intake cover is rotated, the clamping claw drives the adjusting member to rotate along the clamping groove, to cause the third liquid inlet hole to communicate with the first liquid inlet hole or to cause the adjusting member to close the first liquid inlet hole.

10 Claims, 9 Drawing Sheets

(51) Int. Cl.

| | |
|---|---|
| ***A24F 40/40*** | (2020.01) |
| ***A24F 40/485*** | (2020.01) |
| ***A24F 40/49*** | (2020.01) |
| *A24B 15/167* | (2020.01) |

(58) Field of Classification Search
USPC ..... 131/29
See application file for complete search history.

(56) References Cited

FOREIGN PATENT DOCUMENTS

| | | | | | |
|---|---|---|---|---|---|
| CN | 104738816 | A | 7/2015 | | |
| CN | 204670386 | U | 9/2015 | | |
| CN | 205358220 | U | 7/2016 | | |
| CN | 206390297 | U | 8/2017 | | |
| DE | 202015006397 | U1 | 1/2016 | | |
| EP | 3047742 | A1 | 7/2016 | | |
| EP | 3047743 | A1 | 7/2016 | | |
| WO | WO-2016004576 | A1 * | 1/2016 | ..... | A24F 47/008 |
| WO | WO-2017028167 | A1 * | 2/2017 | ..... | A24F 47/008 |

* cited by examiner

ATOMIZER AND ELECTRONIC CIGARETTE HAVING THE SAME

CROSS REFERENCE TO RELATED APPLICATIONS

This application is a 35 U.S.C. § 371 National Phase conversion of International (PCT) Patent Application No. PCT/CN2017/107794, filed on Oct. 26, 2017, which claims the priority of Chinese Patent Application No. 201611019773.X, filed on Nov. 18, 2016. The PCT International Patent Application was filed and published in Chinese.

TECHNICAL FIELD

The present disclosure relates to the technical field of electronic cigarettes, and in particular, to an atomizer and an electronic cigarette having the same.

BACKGROUND

The existing electronic cigarette includes an atomizer and a power supply device, wherein the atomizer is provided with a liquid storage assembly for storing cigarette liquid, and under the electric driving of the power supply device, the cigarette liquid in the liquid storage assembly is heated and atomized into smoke for the user to inhale.

The atomizer includes a liquid storage assembly for storing cigarette liquid and an air guiding assembly that is sealed on the liquid storage assembly. The connection between the two is generally a screw connection or a plug connection. When the liquid storage chamber in the liquid storage assembly is sealed after liquid injection, the liquid storage chamber is compressed due to the screwing operation or the plugging operation, thereby increasing the air pressure in the liquid storage chamber, causing excessive cigarette liquid to enter the atomizing head and be absorbed by the liquid absorbing member. When the liquid absorbing member reaches saturation, the excessive cigarette liquid easily enters the air outlet passage, causing the cigarette liquid to leak.

SUMMARY

In view of the above, it is necessary to provide an atomizer and an electronic cigarette having the same, to prevent leakage of the cigarette liquid.

The technical solution adopted by the present disclosure to solve the above problem is: an atomizer includes a liquid storage assembly and an air guiding assembly detachably connected to the liquid storage assembly. The liquid storage assembly includes a liquid storage pipe having a liquid storage chamber, a connecting member fixed at one end of the liquid storage pipe, an adjusting member rotatably received in the connecting member, and a pressing cover fixed at one end of the connecting member. A bottom wall of the connecting member is provided with at least one first liquid inlet hole communicating with the liquid storage chamber. The adjusting member is provided with a third liquid inlet hole corresponding to the first liquid inlet hole. The pressing cover is provided with at least one clamping groove. The air guiding assembly includes an air intake cover provided with a clamping claw capable of driving the adjustment member to rotate. The clamping claw cooperates with the clamping groove. When the air intake cover is rotated, the clamping claw drives the adjusting member to rotate along the clamping groove, to cause the third liquid inlet hole to communicate with the first liquid inlet hole or to cause the adjusting member to close the first liquid inlet hole.

Further, the clamping claw includes a first claw and a second claw. The adjustment member is provided with at least one limiting slot offset from the third liquid inlet hole. The first claw is engaged in the limiting slot, and the second claw is rotatable along the clamping groove.

Further, the clamping groove is an L-shaped groove. Each L-shaped groove includes a notch defined in an inner wall of the pressing cover along an axial direction of the pressing cover and extending to an upper surface of the pressing cover and a locking slot extending along a circumferential direction of the pressing cover from a lower end of the notch. The second claw is able to enter from the notch to be rotatable and engaged in the locking slot.

Further, an upper surface of the adjusting member is provided with at least one pair of limiting protrusions. The limiting slot is formed by a gap between the two limiting protrusions of each pair of the limiting protrusions.

Further, a limiting portion is protruded from a lower end of the air intake cover adjacent to the liquid storage assembly. The first claw is formed on an outer circumferential surface of the limiting portion, and the second claw is formed on the first claw away from the limiting portion.

Further, the liquid storage assembly further includes a sealing member. The sealing member is fixedly received in one end of the connecting member opposite to the pressing cover. The sealing member is provided with a second liquid inlet hole communicating with the first liquid inlet hole.

Further, the air guiding assembly further includes an air regulating member sleeved on the air intake cover, an air outlet pipe detachably connected to the air intake cover, and a mouthpiece connector detachably connected to an upper end of the air outlet pipe. At least one air intake hole is defined in a side wall of the air intake cover. An air regulating groove communicating with the outside environment is defined in an inner side wall of the air regulating member corresponding to the air intake hole. The air regulating groove is enabled to communicate with or stagger from the air intake hole when the air regulating member is rotated. An inner space of the air outlet pipe forms an air outlet passage communicating with the mouthpiece connector.

Further, the atomizer further includes an atomizing assembly received in the liquid storage assembly. The atomizing assembly includes an atomizing head and a vent pipe detachably connected to an upper end of the atomizing head. An outer circumferential surface of the vent pipe is detachably connected to the connecting member. The vent pipe is sleeved on the air outlet pipe. A space between an inner wall of the vent pipe and an outer wall of the air outlet pipe forms an air inlet passage communicating with the air intake hole. The atomizing head is in communication with the air inlet passage and the air outlet passage, respectively.

Further, the liquid storage assembly further includes a sleeve pipe sleeved on the liquid storage pipe. The connecting member is mounted to an upper end of the sleeve pipe.

An electronic cigarette includes the above atomizer.

The beneficial effects of the present disclosure are: in the atomizer or the electronic cigarette provided by the present disclosure, the adjusting member on the liquid storage assembly is rotated by the air guiding assembly, so that the cigarette liquid is sealed in the liquid storage chamber. During the sealing process, the liquid storage chamber is prevented from being compressed to cause the pressure in the liquid storage chamber to rise, thereby avoiding leakage of excessive cigarette liquid from the air outlet passage. In addition, when the air guiding assembly and the liquid storage assembly are locked, the children are prevented from easily opening the atomizer to avoid contact or ingestion of the cigarette liquid.

BRIEF DESCRIPTION OF THE DRAWINGS

The present disclosure will now be further described with reference to the accompanying drawings and embodiments.

Figure 1:
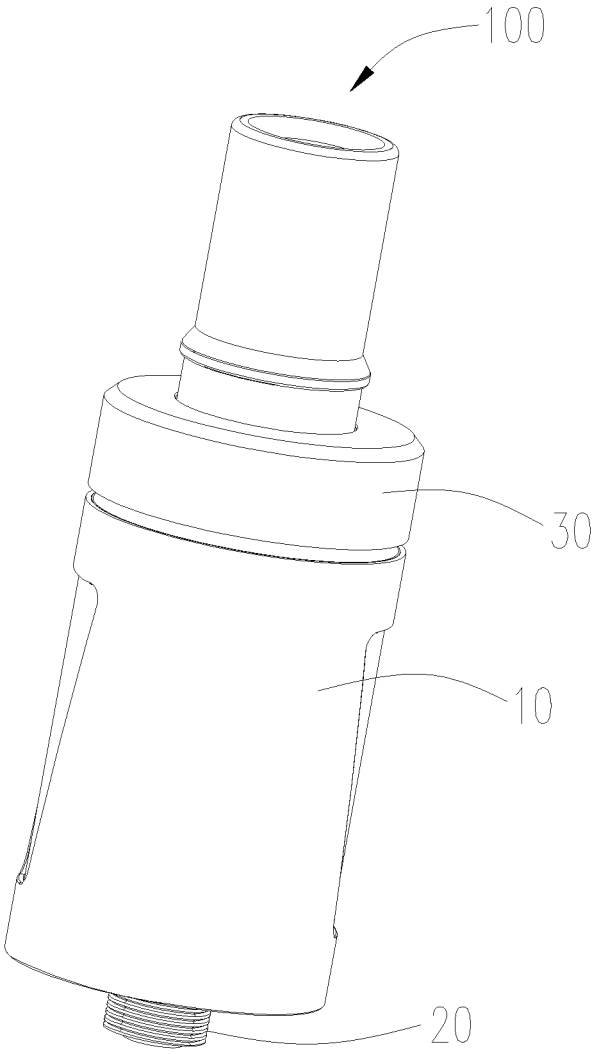
FIG. 1 is a schematic view showing the structure of the atomizer of the present disclosure.

The part names and their reference signs in the figures are:

| | | |
|---|---|---|
| atomizer 100 | liquid storage assembly 10 | bottom seat assembly 20 |
| air guiding assembly 30 | atomizing assembly 40 | sleeve pipe 11 |
| liquid storage pipe 12 | connecting member 13 | sealing member 14 |
| adjusting member 15 | pressing cover 16 | bottom seat 21 |
| first electrode 22 | first insulating member 23 | electrode sleeve 24 |
| second insulating member 25 | air intake cover 31 | air regulating member 32 |
| air outlet pipe 33 | mouthpiece connector 34 | atomizing head 41 |
| vent pipe 42 | second electrode 43 | third insulating member 44 |
| visible window 112 | liquid storage chamber 121 | connecting sleeve 131 |
| first liquid inlet hole 132 | second liquid inlet hole 141 | limiting protrusion 151 |
| limiting slot 152 | notch 161 | locking slot 162 |
| connecting pipe 211 | air intake hole 311 | second internal thread 312 |
| limiting portion 313 | clamping claw 314 | air regulating groove 321 |
| resisting portion 322 | connecting body 331 | tubular body 332 |
| air outlet passage 333 | air inlet passage 421 | first external thread 422 |
| first internal thread 1311 | first claw 3141 | second claw 3142 |
| second external thread 3311 | third liquid inlet hole 153 | L-shaped groove 16a |
| stopping block 163 | first protrusion 133 | second protrusion 154 |
| clamping groove 16b | | |

DETAILED DESCRIPTION OF PREFERRED EMBODIMENTS

The present disclosure will now be described in detail in conjunction with the drawings. These drawings are simplified schematic diagrams illustrating the basic structure of the present disclosure only in a schematic manner, and thus they show only the configuration related to the present disclosure.

Figure 2:
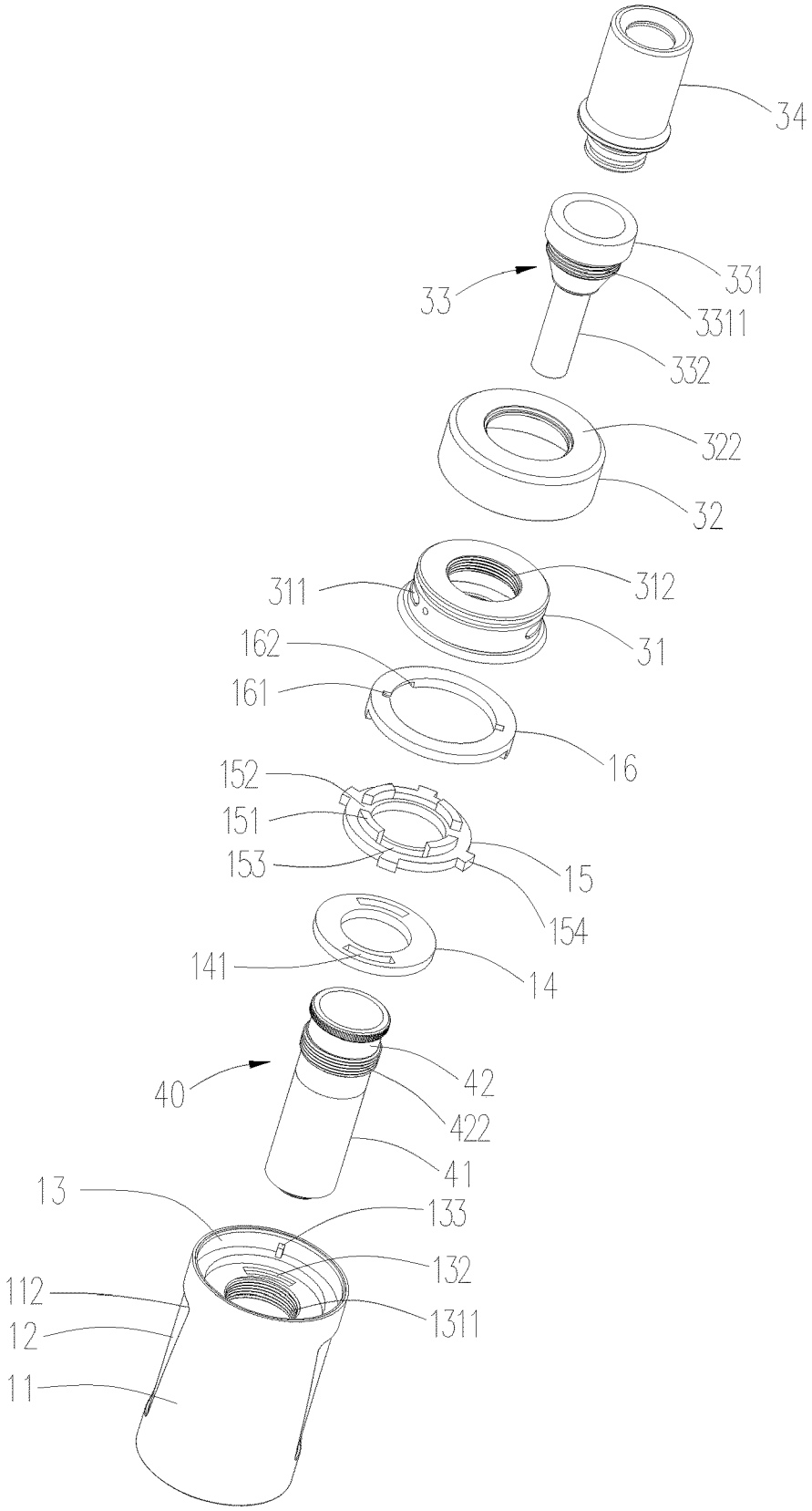
FIG. 2 is a partially exploded view of the atomizer of FIG. 1.
Figure 7:
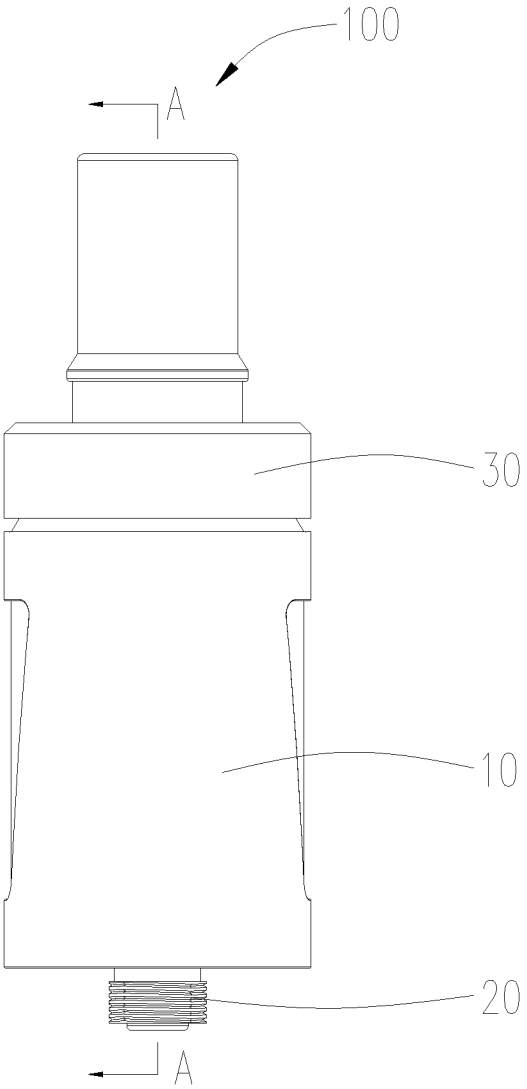
FIG. 7 is a front elevational view of the atomizer of FIG. 1.

Referring to FIG. 1, FIG. 2 and FIG. 7, the present disclosure provides an atomizer 100 including a liquid storage assembly 10, a bottom seat assembly 20, an air guiding assembly 30, and an atomizing assembly 40. The bottom seat assembly 20 is mounted to the lower end of the liquid storage assembly 10, the air guiding assembly 30 is detachably mounted to the upper end of the liquid storage assembly 10, and the atomizing assembly 40 is received in the liquid storage assembly 10.

Figure 3:
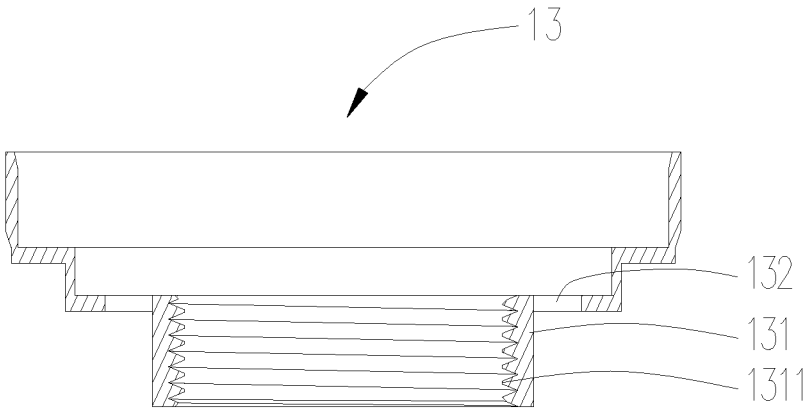
FIG. 3 is a schematic view showing the structure of the connecting member in the atomizer shown in FIG. 2.
Figure 8:
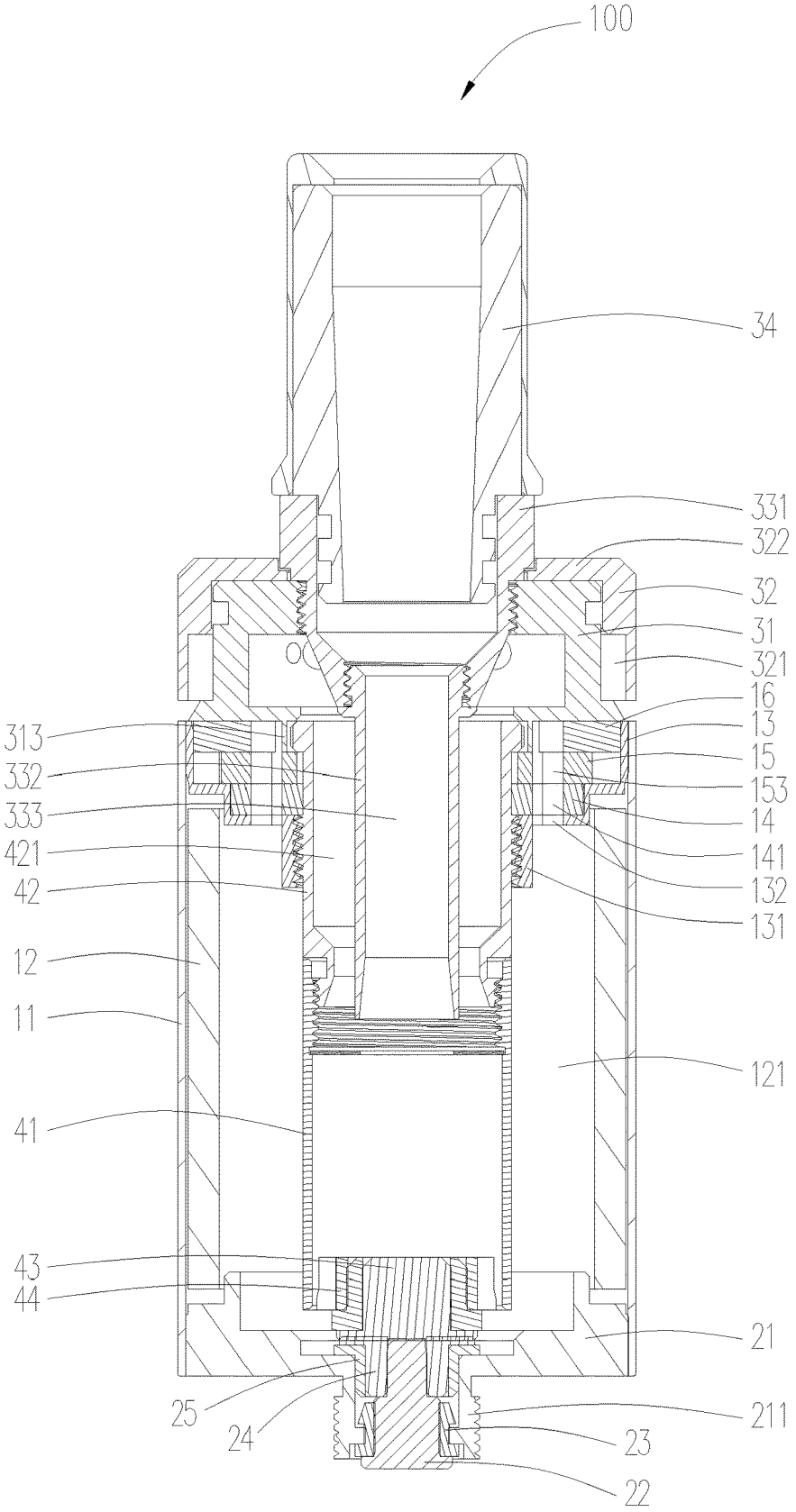
FIG. 8 is a cross-sectional view of the atomizer along the line A-A shown in FIG. 7 (the first liquid inlet hole is in the opening state)

Referring to FIG. 2, FIG. 3 and FIG. 8, the liquid storage assembly 10 includes a sleeve pipe 11, a liquid storage pipe 12 received in the sleeve pipe 11, a connecting member 13 fixed on the upper end of the sleeve pipe 11 and/or the liquid storage pipe 12, and a sealing member 14, an adjusting member 15 and a pressing cover 16 which are sequentially received in the connecting member 13 from bottom to top. The sealing member 14 and the pressing cover 16 are fixedly mounted to the connecting member 13, while the adjusting member 15 is rotatably disposed between the sealing member 14 and the pressing cover 16. It is understood that the fixedly mounting may be a detachable fixed connection or a non-detachable fixed connection.

The sleeve pipe 11 has a tubular structure with openings at the upper and lower ends, and a visible window 112 is opened on the side wall of the sleeve pipe 11. It is understood that the sleeve pipe 11 can be made of glass material, stainless steel material, or glass-bonded stainless steel material, and the user can visually observe the injection amount of the cigarette liquid through the visible window 112 to achieve accurate liquid injection.

The liquid storage pipe 12 has a tubular structure with openings at the upper and lower ends, and the inner space of the liquid storage pipe 12 forms a liquid storage chamber 121 for storing the cigarette liquid. The liquid storage pipe 12 is made of a transparent glass material in order to facilitate observation of the amount of the cigarette liquid inside the liquid storage pipe 12.

The connecting member 13 has a substantially cylindrical structure. The connecting member 13 is assembled on the upper end of the sleeve pipe 11 by an interference fit. A connecting sleeve 131 communicating with the inner space of the connecting member 13 extends downwardly from the center portion of the bottom wall of the connecting member 13. The inner wall of the connecting sleeve 131 is provided with a first internal thread 1311. The bottom wall of the connecting member 13 defines two first liquid inlet holes 132 which are disposed oppositely around the connecting sleeve 131 and communicated with the liquid storage chamber 121. It is understood that the first liquid inlet hole 132 may also be one or more than two.

Further, the inner wall of the connecting member 13 is provided with two first protrusions 133 which are disposed oppositely.

The sealing member 14 has an annular structure. Corresponding to the first liquid inlet holes 132, the sealing member 14 defines two second liquid inlet holes 141 which are disposed oppositely and communicated with the first liquid inlet holes 132. When installed, the sealing member 14 is fixedly mounted on the bottom wall of the connecting member 13 at one end of the connecting member 13 opposite to the pressing cover 16. The second liquid inlet holes 141 are always in communication with the first liquid inlet holes 132.

In this embodiment, the sealing member 14 is made of a rubber material. It is understood that in other embodiments, the sealing member 14 can also be made of a silicone material to achieve a sealing effect.

The adjusting member 15 has a substantially annular structure, and the upper surface of the adjusting member 15 is provided with at least one pair of limiting protrusions 151. One pair of limiting protrusions 151 refers to two adjacent limiting protrusions 151. A limiting slot 152 is defined between the two limiting protrusions 151 of each pair of limiting protrusions 151. The adjusting member 15 defines two third liquid inlet holes 153 corresponding to the second liquid inlet holes 141 and offset from the limiting slots 152. By rotating the adjusting member 15, the third liquid inlet holes 153 are caused to communicate with the second liquid inlet holes 141, or the third liquid inlet holes 153 are caused to stagger from the second liquid inlet holes 141. It is understood that the sealing member 14 can also be omitted, and the adjusting member 15 is directly rotatably disposed on the bottom wall of the connecting member 13.

Optionally, the limiting protrusions 151 have two pairs and are oppositely disposed, and all of the limiting protrusions 151 are on the same circle. A gap between each pair of limiting protrusions 151 forms a limiting slot 152. A third liquid inlet hole 153 is defined between each limiting protrusion 151 of one pair of limiting protrusions 151 and a neighboring limiting protrusion 151 of the other pair of limiting protrusions 151.

Further, the outer circumference of the adjusting member 15 is extended outwardly along the radial direction of the adjusting member 15 to form two pairs of second protrusions 154 which are oppositely disposed, and each pair of second protrusions 154 refers to two adjacent second protrusions 154.

Figure 4:
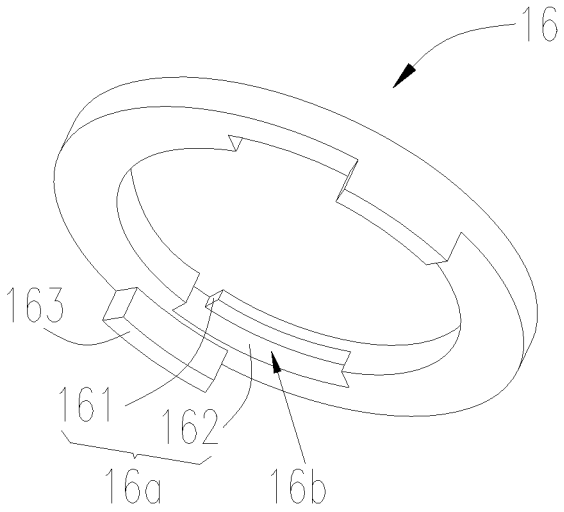
FIG. 4 is a schematic view showing the structure of the pressing cover in the atomizer shown in FIG. 2.

Referring also to FIG. 4, the pressing cover 16 has a substantially annular structure. The pressing cover 16 is assembled on the upper end of the connecting member 13 by an interference fit. The pressing cover 16 is sleeved on the limiting protrusions 151, that is, the outer circumferential surface of the limiting protrusions 151 abuts against the inner circumferential surface of the pressing cover 16. At least one clamping groove **16*b* is defined in the inner wall of the pressing cover 16. Optionally, the clamping groove 16*b* may be an L-shaped groove 16*a*. Each of the L-shaped grooves 16*a* includes a notch 161 defined in the inner wall of the pressing cover 16 along the axial direction of the pressing cover 16 and extending to the upper surface of the pressing cover 16 and a locking slot 162 extending along the circumferential direction of the pressing cover 16 from the lower end of the notch 161. Optionally, two L-shaped grooves 16*a*** are provided.

Further, the lower surface of the pressing cover 16 is provided with two stopping blocks 163 which are oppositely disposed, in order to radially limit the pressing cover 16.

Further, the pressing cover 16 is sleeved on the limiting protrusions 151 of the adjusting member 15 to limit the movement of the adjusting member 15.

Referring to FIG. 8, the bottom seat assembly 20 includes a bottom seat 21 tightly received at the lower end of the sleeve pipe 11, and a first electrode 22, a first insulating member 23, an electrode sleeve 24 and a second insulating member 25 which are mounted on the bottom seat 21.

The bottom seat 21 has a substantially cylindrical structure, and the bottom seat 21 is mounted at the lower end of the sleeve pipe 11 by an interference fit. A connecting pipe 211 communicating with the inner space of the bottom seat 21 extends downward from the center portion of the bottom surface of the bottom seat 21. The first insulating member 23 and the first electrode 22 are installed in the lower end of the connecting pipe 211, and the second insulating member 25 and the electrode sleeve 24 are installed in the upper end of the connecting pipe 211. One end of the first electrode 22 is received in the electrode sleeve 24 and is electrically connected to the electrode sleeve 24. The other end of the first electrode 22 is electrically connected to a power supply device (not shown). The first insulating member 23 is interposed between the connecting pipe 211 and the first electrode 22, and the second insulating member 25 is interposed between the connecting pipe 211 and the electrode sleeve 24.

Between the liquid storage pipe 12 and the connecting member 13 and between the liquid storage pipe 12 and the bottom seat 21, a sealing member (not shown) is mounted to seal the cigarette liquid in the liquid storage chamber 121.

Referring to FIG. 2 and FIG. 7, the air guiding assembly 30 includes an air intake cover 31 detachably connected to the liquid storage assembly 10, an air regulating member 32 rotatably sleeved on the air intake cover 31, an air outlet pipe 33 detachably connected to the air intake cover 31, and a mouthpiece connector 34 detachably connected to the air outlet pipe 33.

Figure 5:
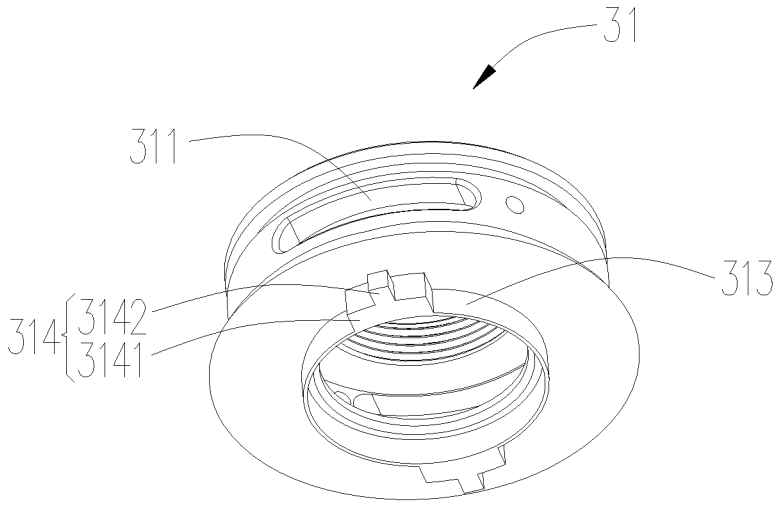
FIG. 5 is a schematic view showing the structure of the air intake cover in the atomizer shown in FIG. 2.

Referring also to FIG. 5, the air intake cover 31 has a substantially hollow cylindrical structure with openings at both ends. At least one air intake hole 311 is defined in the side wall of the air intake cover 31. The upper end of the air intake cover 31 is provided with a second internal thread 312. The lower surface of the air intake cover 31 is provided with an annular limiting portion 313, and two oppositely disposed clamping claws 314 are protruded from the outer wall of the limiting portion 313.

The clamping claw 314 is substantially in a convex shape, and the clamping claw 314 includes a first claw 3141 and a second claw 3142. The first claw 3141 is fixedly formed on the outer circumferential surface of the limiting portion 313, and the second claw 3142 is formed on the first claw 3141 away from the limiting portion 313. The second claw 3142 cooperates with the notch 161 and the locking slot 162 of the pressing cover 16, and the first claw 3141 cooperates with the limiting slot 152 of the adjusting member 15. It is noted that, when the air intake cover 31 is separated from the pressing cover 16, the positional relationship between the notch 161 of the pressing cover 16 and the limiting slot 152 of the adjusting member 15 corresponds to the positional relationship of the first claw 3141 and the second claw 3142. In use, the second claw 3142 enters from the above of the notch 161, and the first claw 3141 is engaged in the limiting slot 152. In the process of rotating the second claw 3142 into the locking slot 162, the top surface of the second claw 3142 abuts against the inner wall of the locking slot 162, and the first claw 3141 drives the adjusting member 15 to rotate. The circumferential length of the locking slot 162 limits the rotation angle of the adjusting member 15.

In the embodiment of the present disclosure, the first claw 3141 and the second claw 3142 are integrally provided. It is understood that the first claw 3141 and the second claw 3142 can also be staggered on the outer circumferential surface of the limiting portion 313.

Further, when the second claw 3142 is connected to the notch 161, one of the first protrusions 133 abuts a second protrusion 154 of one pair of second protrusions 154, and the other one of the first protrusions 133 abuts a second protrusion 154 of the other pair of second projections 154, so that the adjustment member 15 can only rotate in the rotational direction of the clamping claw 314.

It is understood that the specific shape of the clamping groove 16*b* is not limited, so long as the clamping groove 16*b* can be used for accommodating the clamping claw 314 and restricting the movement of the clamping claw 314. For example, the clamping groove 16*b* may be a square groove, a diamond groove, etc.

It is understood that the specific shape of the clamping claw 314 is not limited, as long as the clamping claw 314 can rotate inside of the clamping groove 16*b* to drive the adjusting member 15 to rotate simultaneously, that is, the clamping claw 314 can drive the adjusting member 15 to rotate along the clamping groove 16*b*. For example, in other embodiments not shown, the clamping claw 314 may be provided as a protrusion and a groove connected to the protrusion for accommodating the limiting protrusion 151, wherein the protrusion is used to be inserted into the clamping groove 16*b*, and the groove abuts against both ends of the limiting projection 151 in the circumferential direction, so that the adjusting member 15 can be driven to rotate.

Figure 6:
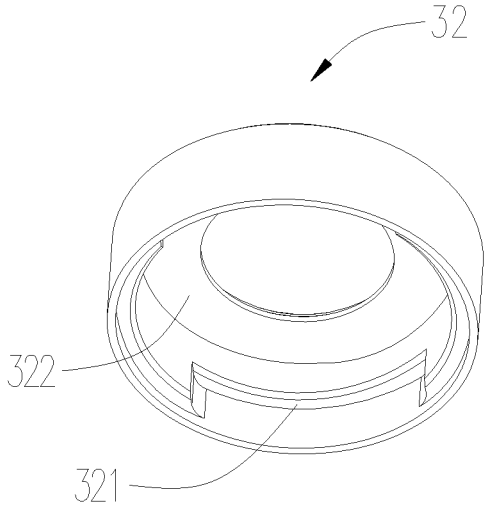
FIG. 6 is a schematic view showing the structure of the air regulating member in the atomizer shown in FIG. 2.

Referring to FIG. 6, the air regulating member 32 has a substantially sleeve-like structure. The inner side wall of the air regulating member 32 is defined with air regulating grooves 321 corresponding to the air intake holes 311 and communicating with the outside environment. A resisting portion 322 is formed by extending radially inwardly from the upper end of the air regulating member 32, and the resisting portion 322 abuts against the upper surface of the air intake cover 31 when mounted.

Referring to FIG. 8, the air outlet pipe 33 includes a connecting body 331 and a tubular body 332 detachably connected to the lower end of the connecting body 331. The connecting body 331 has a substantially trumpet-like structure, and the tubular body 332 has a hollow tubular structure with openings at both ends. In this embodiment, the connecting body 331 and the tubular body 332 are fixedly connected by screws. It is understood that the connecting body 33 and the tubular body 332 can also be a unitary structure, that is, the air outlet pipe 33 is formed as a whole.

Referring to FIG. 2, the outer wall of the connecting body 331 is provided with a second external thread 3311 matching with the second internal thread 312. When installed, the air outlet pipe 33 is detachably mounted on the air intake cover 31 by the cooperation of the second internal thread 312 and the second external thread 3311.

The inner space of the air outlet pipe 33 forms an air outlet passage 333.

The mouthpiece connector 34 has a substantially hollow tubular structure with openings at both ends. The lower end of the mouthpiece connector 34 is detachably mounted to the connecting body 331 of the air outlet pipe 33 by plugging. It is understood that the mouthpiece connector 34 can also be mounted to the air outlet pipe 33 by threads, clamps, etc.

In the embodiment of the present disclosure, the mouthpiece connector 34 can be directly used as a cigarette holder, and the user directly sucks the mouthpiece connector 34 to smoke. It is understood that a hollow suction member having openings at both ends may also be mounted to the mouthpiece connector 34, the user sucks the suction member to smoke.

Figure 9:
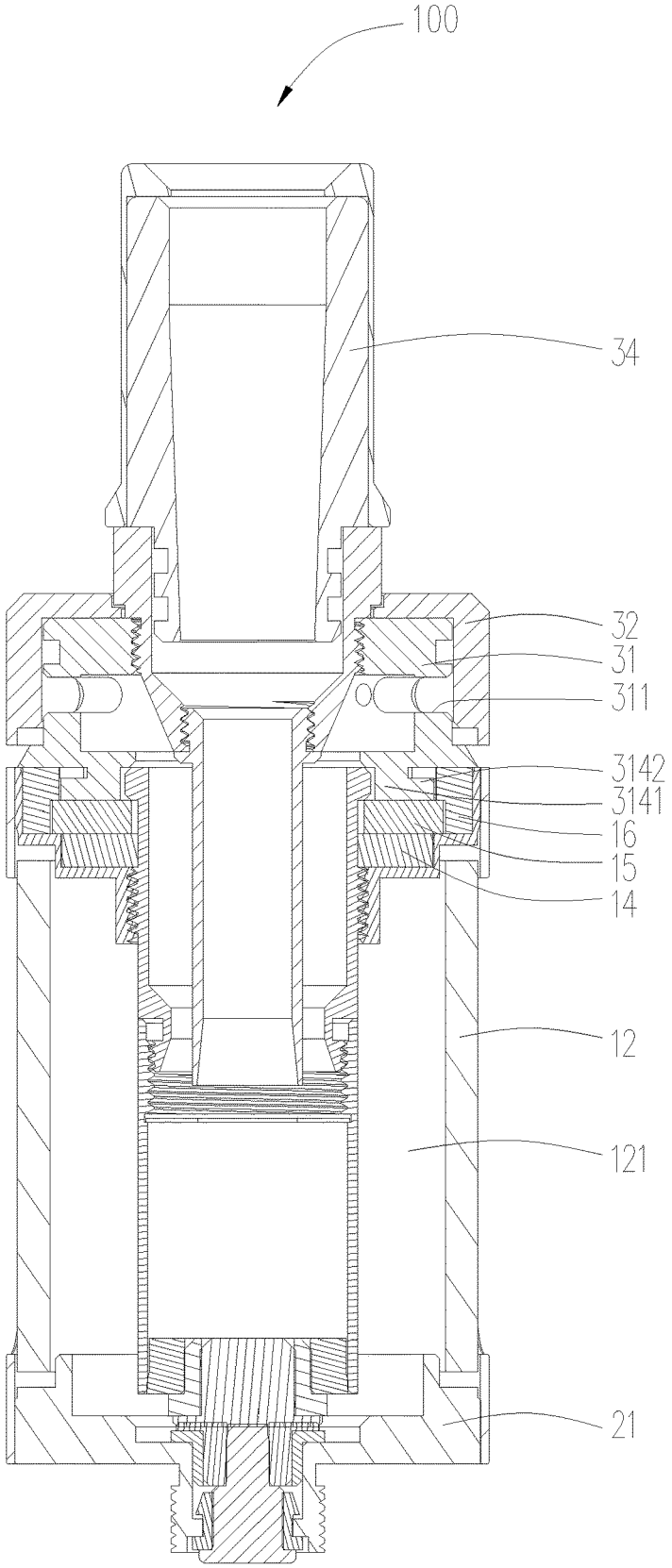
FIG. 9 is a cross-sectional view of the atomizer of FIG. 8 when it is rotated 90° (the first liquid inlet hole is in the opening state)

Referring to FIG. 8 and FIG. 9, the atomizing assembly 40 includes an atomizing head 41, a vent pipe 42 mounted on the upper end of the atomizing head 41, and a second electrode 43 and a third insulating member 44 which are mounted on the lower end of the atomizing head 41.

During installation, the atomizing head 41 and the vent pipe 42 are detachably connected by threads. The lower end of the air outlet pipe 33 is received in the vent pipe 42, and the space between the inner wall of the vent pipe 42 and the outer wall of the air outlet pipe 33 forms an air inlet passage 421 communicating with the air intake holes 311. The interior of the atomizing head 41 communicates with the air inlet passage 421 and the air outlet passage 333, respectively.

One end of the second electrode 43 is electrically connected to the electrode sleeve 24, and the other end of the second electrode 43 is electrically connected to a heating member (not shown) inside the atomizing head 41. The cigarette liquid absorbed by the liquid absorbing member (not shown) inside the atomizing head 41 is atomized into smoke when the power supply device heats the heating member.

Further, the third insulating member 44 is sleeved on the second electrode 43 for providing insulation effect.

The outer wall of the vent pipe 42 is provided with a first external thread 422 matching with the first internal thread 1311, and the vent pipe 42 is detachably connected to the connecting member 13 by the cooperation of the first internal thread 1311 and the first external thread 422. At this time, the vent pipe 42 extends through the seal member 14, the adjusting member 15 and the pressing cover 16.

It is understood that in the above embodiments, the detachable connection includes, but is not limited to, a thread connection, a clamping connection and a magnetic connection.

The use of the atomizer of the present disclosure will be described below with reference to the accompanying drawings.

Referring to FIG. 8 and FIG. 9 simultaneously, when the liquid storage assembly 10 is separated from the air guiding assembly 30, the first liquid inlet holes 132 of the connecting member 13, the second liquid inlet holes 141 of the sealing member 14 and the third liquid inlet holes 153 of the adjusting member 15 are aligned to each other and are respectively communicated with the liquid storage chamber 121. The notch 161 of the pressing cover 16 is aligned with the second claw 3142 of the air intake cover 31, and the limiting slot 152 of the adjusting member 15 is aligned with the first claw 3141 of the same clamping claw 314.

Figure 10:
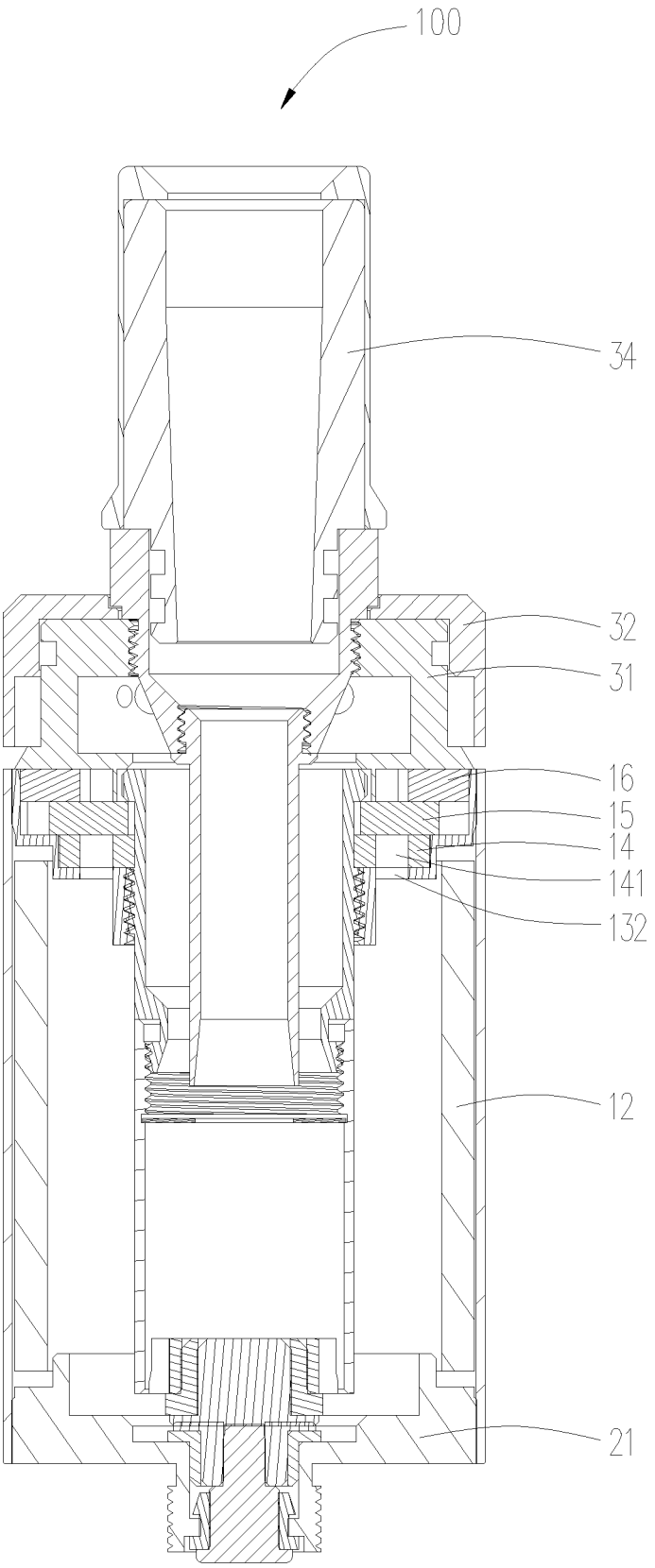
FIG. 10 is another cross-sectional view of the atomizer shown in FIG. 7 (the first liquid inlet hole is in the closed state)
Figure 11:
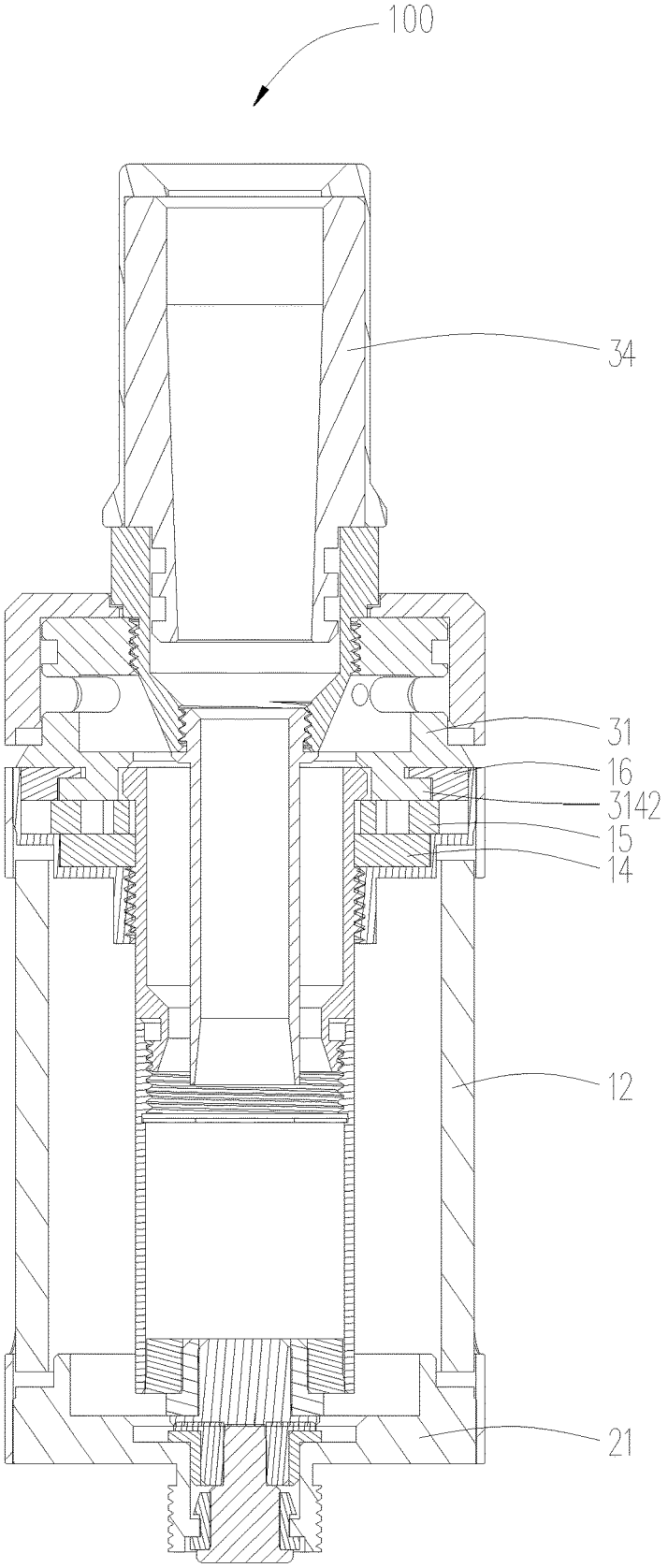
FIG. 11 is a cross-sectional view of the atomizer of FIG. 10 when it is rotated 90° (the first liquid inlet hole is in the closed state).

During liquid injection, the cigarette liquid is finally injected into the liquid storage chamber 121 sequentially through the third liquid inlet holes 153, the second liquid inlet holes 144 and the first liquid inlet holes 132, until the liquid injection process is finished. When the air guiding assembly 30 is assembled with the liquid storage assembly 10, the space in the liquid storage chamber 121 is compressed, the air in the liquid storage chamber 121 is discharged from the liquid storage assembly 10 by passing through the first liquid inlet holes 132 of the connecting member 13, the second liquid inlet holes 141 of the sealing member 14 and the third liquid inlet holes 153 of the adjusting member 15, so that the cigarette liquid in the liquid storage chamber 121 is avoided to be compressed into the vent pipe 42 by passing through the atomizing head 41. Referring to FIG. 10 and FIG. 11, it is required to mount the air guiding assembly 30 to the liquid storage assembly 10 after the liquid injection process, the second claw 3142 enters through the notch 161, and the air intake cover 31 is rotated to cause the second claw 3142 to move along the locking slot 162 so as to be engaged in the locking slot 162. In the mounting process, the first claw 3141 is engaged in the limiting slot 152 of the adjusting member 15 and drives the adjusting member 15 to rotate until the second claw 3142 is engaged at the distal end of the locking slot 162 and the adjusting member 15 stops rotating. At this time, the adjusting member 15 closes the second liquid inlet holes 141 of the sealing member 14, so that the cigarette liquid is not easily leaked. In addition, the second claw 3142 is engaged in the locking slot 162 to realize the fixed connection between the air intake cover 31 and the pressing cover 16. Thus, the air guiding assembly 30 and the liquid storage assembly 10 are fixedly connected for use by the user.

When it is required to perform liquid injection, the air guiding assembly 30 is reversely rotated, and the adjusting member 15 is reversely rotated by the air intake cover 31, so that the second liquid inlet holes 141 and the third liquid inlet holes 153 are communicated with each other. At the same time, the second claw 3142 of the air intake cover 31 is finally separated from the pressing cover 16 through the locking slot 162 and the notch 161, and the air guiding assembly 30 can be separated from the liquid storage assembly 10.

When the user sucks, the air regulating member 32 can be rotated to adjust the overlapping area of the air regulating groove 321 and the air intake hole 311 to control the amount of air intake. The external air enters through the air regulating groove 321, the air intake hole 311 and the air inlet passage 421 in sequence, mixes with the smoke, and then enters the user's mouth through the air outlet passage 333 and the mouthpiece connector 34 in sequence.

In the atomizer 100 of the present disclosure, the air intake cover 31 can drive the adjusting member 15 to rotate, to close or open the liquid storage chamber 121, and also to lock or separate the air guiding assembly 30 and the liquid storage assembly 10. Compared with the conventional methods by threads and plugging, when the atomizer 100 of the present disclosure closes the liquid storage chamber 121, the liquid storage chamber 121 is prevented from being compressed, the leakage of the cigarette liquid due to the excessive high pressure of the liquid storage chamber 121 is not caused. In addition, when the air guiding assembly 30 and the liquid storage assembly 10 are locked, the children are prevented from easily opening the atomizer by a single action to avoid contact or ingestion of the cigarette liquid.

The present disclosure also provides an electronic cigarette having the atomizer 100 described above and a power supply device (not shown) connected to the atomizer 100, so that the electronic cigarette has the same technical effects as the atomizer 100 described above.

In view of the above-described embodiments of the present disclosure, various changes and modifications can be made by those skilled in the art without departing from the scope of the present disclosure. The scope of the present disclosure is not limited to the contents of the specification, and the scope thereof must be determined in accordance with the scope of the claims.

The invention claimed is:

1. An atomizer, comprising a liquid storage assembly and an air guiding assembly detachably connected to the liquid storage assembly, the liquid storage assembly comprising a liquid storage pipe having a liquid storage chamber, a connecting member fixed at one end of the liquid storage pipe, an adjusting member rotatably received in the connecting member, and a pressing cover fixed at one end of the connecting member, wherein a bottom wall of the connecting member is provided with at least one first liquid inlet hole communicating with the liquid storage chamber, the adjusting member is provided with a third liquid inlet hole corresponding to the first liquid inlet hole, the pressing cover is provided with at least one clamping groove, the air guiding assembly comprises an air intake cover provided with a clamping claw capable of driving the adjusting member to rotate, the clamping claw cooperates with the clamping groove, when the air intake cover is rotated, the clamping claw drives the adjusting member to rotate along the clamping groove, to cause the third liquid inlet hole to communicate with the first liquid inlet hole or to cause the adjusting member to close the first liquid inlet hole.

2. The atomizer according to claim 1, wherein the clamping claw comprises a first claw and a second claw, the adjusting member is provided with at least one limiting slot offset from the third liquid inlet hole, the first claw is engaged in the limiting slot, the second claw is rotatable along the clamping groove.

3. The atomizer according to claim 2, wherein the clamping groove is an L-shaped groove, the L-shaped groove includes a notch defined in an inner wall of the pressing cover along an axial direction of the pressing cover and extending to an upper surface of the pressing cover and a locking slot extending along a circumferential direction of the pressing cover from a lower end of the notch, the second claw is able to enter from the notch to be rotatable and engaged in the locking slot.

4. The atomizer according to claim 3, wherein an upper surface of the adjusting member is provided with at least one pair of limiting protrusions, the limiting slot is formed by a gap between the two limiting protrusions of each pair of the limiting protrusions.

5. The atomizer according to claim 4, wherein a limiting portion is protruded from a lower end of the air intake cover adjacent to the liquid storage assembly, the first claw is formed on an outer circumferential surface of the limiting portion, the second claw is formed on the first claw away from the limiting portion.

6. The atomizer according to claim 1, wherein the liquid storage assembly further comprises a sealing member, the sealing member is fixedly received in one end of the connecting member opposite to the pressing cover, the sealing member is provided with a second liquid inlet hole communicating with the first liquid inlet hole.

7. The atomizer according to claim 1, wherein the air guiding assembly further comprises an air regulating member sleeved on the air intake cover, an air outlet pipe detachably connected to the air intake cover, and a mouthpiece connector detachably connected to an upper end of the air outlet pipe, at least one air intake hole is defined in a side wall of the air intake cover, an air regulating groove communicating with the outside environment is defined in an inner side wall of the air regulating member corresponding to the air intake hole, the air regulating groove is enabled to communicate with or stagger from the air intake hole when the air regulating member is rotated, an inner space of the air outlet pipe forms an air outlet passage communicating with the mouthpiece connector.

8. The atomizer according to claim 7, wherein the atomizer further comprises an atomizing assembly received in the liquid storage assembly, the atomizing assembly comprises an atomizing head and a vent pipe detachably connected to an upper end of the atomizing head, an outer circumferential surface of the vent pipe is detachably connected to the connecting member, the vent pipe is sleeved on the air outlet pipe, a space between an inner wall of the vent pipe and an outer wall of the air outlet pipe forms an air inlet passage communicating with the air intake hole, the atomizing head is in communication with the air inlet passage and the air outlet passage, respectively.

9. The atomizer according to claim 1, wherein the liquid storage assembly further comprises a sleeve pipe sleeved on the liquid storage pipe, the connecting member is mounted to an upper end of the sleeve pipe.

10. An electronic cigarette, comprising the atomizer according to claim 1.

* * * * *